US009028049B2

(12) United States Patent
Azuma et al.

(10) Patent No.: US 9,028,049 B2
(45) Date of Patent: May 12, 2015

(54) INKJET PRINTING APPARATUS AND INKJET PRINTING METHOD

(71) Applicant: Canon Kabushiki Kaisha, Tokyo (JP)

(72) Inventors: Satoshi Azuma, Kawasaki (JP); Yoshiaki Murayama, Tokyo (JP); Kei Kosaka, Tokyo (JP); Makoto Torigoe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/909,318

(22) Filed: Jun. 4, 2013

(65) Prior Publication Data

US 2013/0328969 A1 Dec. 12, 2013

(30) Foreign Application Priority Data

Jun. 8, 2012 (JP) ..... 2012-130659

(51) Int. Cl.

| | |
|---|---|
| ***B41J 2/135*** | (2006.01) |
| ***B41J 29/38*** | (2006.01) |
| ***B41J 2/145*** | (2006.01) |
| ***B41J 2/155*** | (2006.01) |

(52) U.S. Cl.

CPC *B41J 2/145* (2013.01); *B41J 2/155* (2013.01); *B41J 2202/12* (2013.01); *B41J 2202/19* (2013.01); *B41J 2202/20* (2013.01)

(58) Field of Classification Search

CPC .... B41J 2/2132; B41J 2/2128; B41J 2/04568; B41J 2/07; B41J 2/04535

USPC ..... 347/12, 15, 40, 41, 5, 6, 13, 14, 44

See application file for complete search history.

(56) References Cited

U.S. PATENT DOCUMENTS

| | | | | |
|---|---|---|---|---|
| 6,257,698 | B1 * | 7/2001 | Bloomberg et al. | 347/40 |
| 6,377,358 | B1 * | 4/2002 | Hayasaki et al. | 358/1.16 |
| 7,328,963 | B2 * | 2/2008 | Tajika et al. | 347/19 |
| 7,374,265 | B2 * | 5/2008 | Yamane et al. | 347/13 |
| 7,441,854 | B2 * | 10/2008 | Jahana et al. | 347/14 |
| 2002/0063749 | A1 * | 5/2002 | Kanda et al. | 347/41 |
| 2007/0120883 | A1 * | 5/2007 | Tsuboi | 347/14 |
| 2007/0165068 | A1 * | 7/2007 | Tsuboi | 347/41 |
| 2009/0160895 | A1 * | 6/2009 | Matsuzawa | 347/12 |
| 2010/0156980 | A1 * | 6/2010 | Azuma et al. | 347/14 |

FOREIGN PATENT DOCUMENTS

| | | | | |
|---|---|---|---|---|
| EP | 914950 | A2 * | 5/1999 | B41J 2/155 |
| EP | 1543976 | A2 * | 6/2005 | B41J 2/155 |
| JP | 05-057965 | A | 3/1993 | |

* cited by examiner

*Primary Examiner* — Matthew Luu
*Assistant Examiner* — Patrick King
(74) *Attorney, Agent, or Firm* — Fitzpatrick, Cella, Harper & Scinto

(57) ABSTRACT

The effects on an image are maximally decreased with respect to ejection by printing elements included in the low flow rate areas of a serial channel in an inkjet printing apparatus that uses a joined head in which multiple chips provided with multiple printing element arrays are disposed. For this purpose, print data is distributed to individual printing elements at a joining portion between two chips, such that fewer printing elements execute ejection operations on a printing element array A distanced farther from the center line of a base plate than a printing element array D nearer the center line. Doing so suppresses ejection by printing elements included in low flow rate areas which manifest near the turns of an ink channel, and reduces density defects due to ejection by such printing elements.

16 Claims, 20 Drawing Sheets

INKJET PRINTING APPARATUS AND INKJET PRINTING METHOD

BACKGROUND OF THE INVENTION

1. Field of the Invention

The present invention relates to an inkjet printing apparatus, and more particularly, to a printing method for suppressing density unevenness due to the differing properties of ink inside an ink channel depending on the position inside the channel in a joined head made up of multiple chips joined together.

2. Description of the Related Art

In order to improve manufacturing yield, an inkjet print head may be configured as an elongated print head in which comparatively short chips with multiple printing elements laid out thereon are joined together in the printing element arranging direction. In this case, in order to keep defects such as white streaks caused by chip misalignments from appearing in an image, the individual chips are typically disposed with alternating differences in a direction intersecting the arranging direction, while providing a predetermined overlapping portion (joining portion) between the individual chips in the arranging direction. Also, in order to print a continuous 1-pixel line in the print medium conveying direction distributed across multiple printing elements, a print head arrayed with multiple printing element arrays for ejecting the same ink in the conveying direction is also provided.

FIG. 1 is a diagram illustrating an example of a joined head configured in this way. Multiple chips 130 are disposed continuously in the X direction on a base plate 120 while providing a joining portion 199 of predetermined size, with the chips 130 being alternately shifted in the Y direction so as to straddle a center line 1200 extending in the X direction.

FIG. 2 is a diagram illustrating the path of an ink channel for sharing ink among multiple chips 130. The ink channel 190 is provided on the base plate 120 while curving in a zigzag manner as illustrated in FIG. 2, and guides ink received from an ink supply port 170 to an ink discharge port 171 while supplying ink to each of the multiple chips 130 successively and in series. In the individual chips 130, supplied ink is ejected from individual printing elements in accordance with print data received from a printing apparatus.

Forming the ink channel 190 in a zigzag pattern in this way increases the adhesion area with the laminar base plate 120, and has the effect of ensuring adhesion strength. However, there are also concerns that the ink flow rate decreases near the individual turns compared to the other areas. In addition, in the areas 1100 where the ink flow rate decreases in this way, ink properties such as temperature and concentration as well as the quantity of discharged ink change with respect to the other areas, and results in noticeably density unevenness in an image in some cases.

Japanese Patent Laid-Open No. H05-057965 (1993) discloses a configuration for avoiding noticeable discontinuities in an image at the joining portions of a joined head, in which a number of the printing elements that actually conduct ejection operations are gradually increased from the end of the chips and proceeding inwards, even in the same joining portion. If Japanese Patent Laid-Open No. H05-057965 (1993) is implemented, even if the ink properties change in the low flow rate areas 1100 of the channel, such areas are almost entirely contained within the joining portions, thus making it possible to reduce the number of ejections by printing elements included in the low flow rate areas 1100, and suppress image defects such as density unevenness.

However, the configuration of Japanese Patent Laid-Open No. H05-057965 (1993) gradually increases the number of printing elements used for actual ejection from the edge towards the center. Thus, several printing elements are used for ejection operations even though the printing elements are included in the low flow rate areas 1100, and ink droplets with different densities and ejection amounts are unavoidably ejected to some degree.

Also, in the case of a joined head configured as in FIG. 1, since the low flow rate areas 1100 appear at the turns of the ink channel 190 as illustrated in FIG. 2, the numbers of printing elements included in the low flow rate areas 1100 differ by the individual printing element arrays. However, since Japanese Patent Laid-Open No. H05-057965 (1993) is proposed for the case where there is basically one array of printing elements each laid out on the individual chips, no consideration is predetermined for the ejection properties between printing element arrays in the case of laying out multiple printing element arrays on the individual chips as in FIG. 1.

SUMMARY OF THE INVENTION

The present invention has been devised in order to solve the above problems. Consequently, an object of the present invention is to maximally decrease the effects on an image of ejection by printing elements included in the low flow rate areas of a serial channel in an inkjet printing apparatus that uses a joined head in which multiple chips provided with multiple printing element arrays are disposed.

In a first aspect of the present invention, there is provided an inkjet printing apparatus that prints an image on the print medium comprising: an inkjet print head provided with a printing element substrate including a plurality of chips made up of a plurality of printing element arrays, which contain printing elements used to eject ink arranged in a predetermined arranging direction on a base plate for supporting the plurality of chips, wherein the plurality of chips are disposed in an direction intersecting with the arranging direction, the chips being disposed on alternating sides of a center line of the base plate substantially parallel to the arranging direction such that the printing elements are contiguous in the arranging direction, while also providing joining portions where adjacent chips which disposed on each side of the center line overlap each other in the arranging direction; and an ink channel provided in the base plate and having a plurality of turns so as to supply ink to each of the plurality of chips on the base plate successively and in series; and a distributing unit configured to distribute print data to each of the plurality of printing elements at the joining portions such that, among the plurality of printing element arrays on the chips, fewer printing elements execute ejection operations on a first printing element array than a second printing element array which is positioned closer to the center line than the first printing element array.

In a second aspect of the present invention, there is provided an inkjet printing method that prints an image using an inkjet print head provided with a printing element substrate including a plurality of chips made up of a plurality of printing element arrays, which contain printing elements used to eject ink arranged in a predetermined arranging direction on a base plate for supporting the plurality of chips, wherein the plurality of chips are disposed in an direction intersecting with the arranging direction, the chips being disposed on alternating sides of a center line of the base plate substantially parallel to the arranging direction such that the printing elements are contiguous in the arranging direction, while also providing joining portions where adjacent chips which disposed on each side of the center line overlap each other in the arranging direction; and an ink channel provided in the base plate and having a plurality of turns so as to supply ink to each of the plurality of chips on the base plate successively and in series, the inkjet printing method comprising: distributing print data to each of the plurality of printing elements at the joining portions such that, among the plurality of printing element arrays on the chips, fewer printing elements execute ejection operations on a first printing element array than a second printing element array which is positioned closer to the center line than the first printing element array.

In a third aspect of the present invention, there is provided an inkjet printing apparatus that prints an image on the print medium comprising: an inkjet print head provided with a printing element substrate including a plurality of chips made up of a plurality of printing element arrays, which contain printing elements used to eject ink arranged in a predetermined arranging direction on a base plate for supporting the plurality of chips, wherein the plurality of chips are disposed in an direction intersecting with the arranging direction, the chips being disposed on alternating sides of a center line of the base plate substantially parallel to the arranging direction such that the printing elements are contiguous in the arranging direction, while also providing joining portions where adjacent chips which disposed on each side of the center line overlap each other in the arranging direction; and an ink channel provided in the base plate and having a plurality of turns so as to supply ink to each of the plurality of chips on the base plate successively and in series; and a determining unit configured to determine a rate of use of each of the plurality of printing elements at the joining portions such that, among the plurality of printing element arrays on the chips, fewer printing elements execute ejection operations on a first printing element array than a second printing element array which is positioned further from the turn of the ink channel than the first printing element array.

Further features of the present invention will become apparent from the following description of exemplary embodiments (with reference to the attached drawings).

DESCRIPTION OF THE EMBODIMENTS

Hereinafter, exemplary embodiments of the present invention will be described. First, an example of a printing apparatus able to realize several specific embodiments discussed later will be described.

Figure 3:
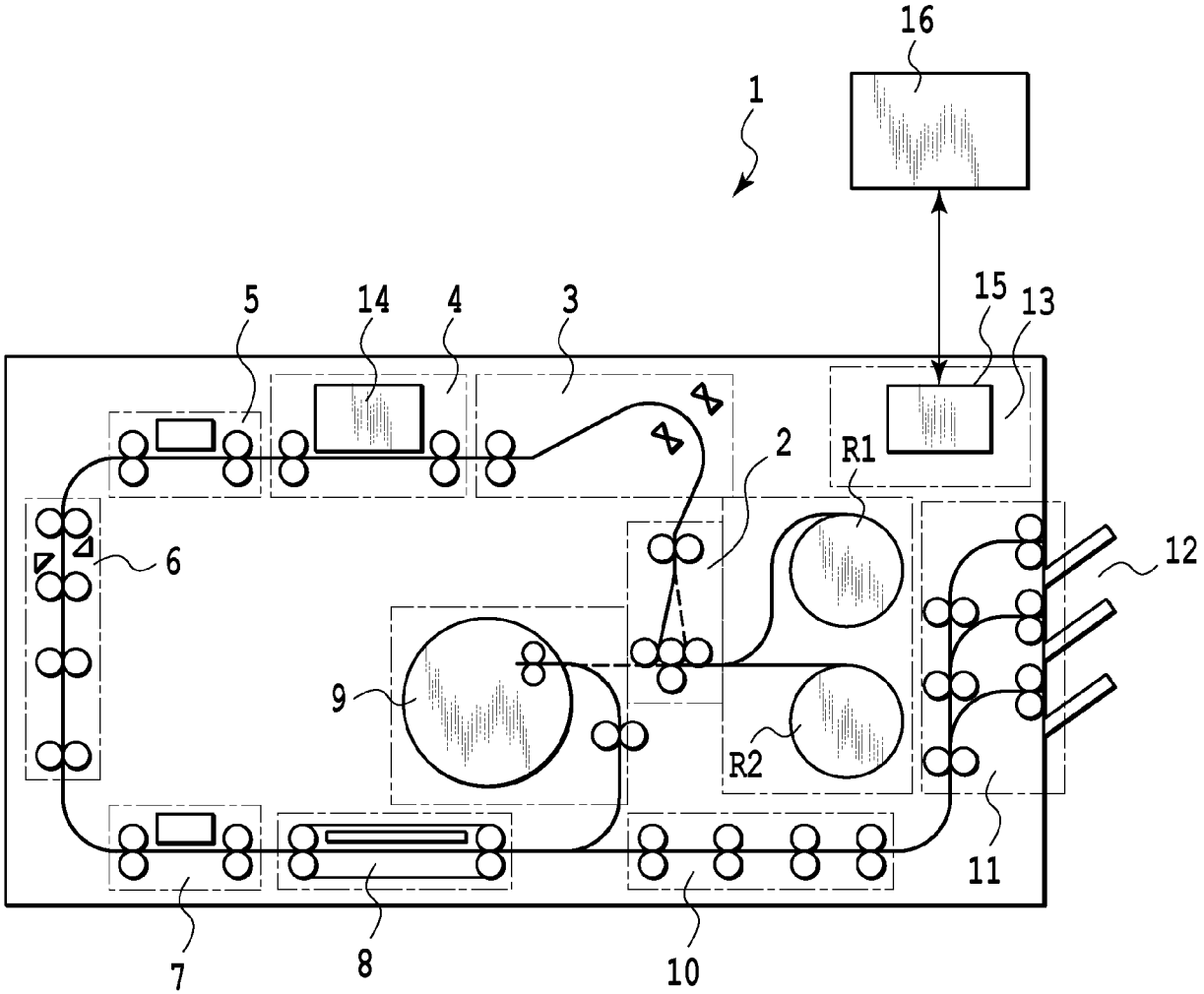
FIG. 3 is a cross-section view illustrating an internal configuration of a full-line inkjet printing apparatus.

FIG. 3 is a cross-section view illustrating an internal configuration of a full-line inkjet printing apparatus 1 usable by the present invention. The inkjet printing apparatus 1 is primarily provided with the respective units of a sheet feeder 1, a decurler 2, a skew corrector 3, a printing unit 4, an inspecting unit 5, a cutter unit 6, an information printing unit 7, a drying unit 8, a sheet winding unit 9, a delivery conveying unit 10, a sorter 11, a delivery tray 12, and a control unit 13. Solid lines in FIG. 3 represent the conveying path of a sheet conveyed from the sheet feeder 1 to the delivery tray 12.

The sheet feeder 1 is provided with roll sheets R1 and R2 wound in a roll. When printing, the sheet feeder 1 selectively draws out a sheet from one of the roll sheets and conveys the sheet to the decurler 2.

The decurler 2 is a unit that reduces curl in the sheet supplied by the sheet feeder 1. The decurler 2 is provided with two pinch rollers with respect to one drive roller, and imparts curl in the opposite direction to the supplied roll sheet, thus reducing curl.

The skew corrector 3 is a unit that corrects skew (tilt with respect to the original conveying direction) in the sheet passing through the decurler 2. Skew in a sheet is corrected by pressing the sheet edge on a side used as reference against a guide member.

The printing unit 4 is a unit that forms an image on a sheet using a print head 14 with respect to the being conveyed sheet. The printing unit 4 is provided with multiple conveying rollers that conveys the sheet and keep the ejecting face of inkjet print head 14 (hereinafter simply referred to as the print head) at a constant distance. The print head 14 is made up of print heads like that illustrated in FIG. 18, with respective print heads for each of the ink colors being arranged in the conveying direction (Y direction). Herein, seven print heads corresponding to the seven colors of cyan (C), magenta (M), yellow (Y), light cyan (LC), light magenta (LM), gray (G), and black (K) are taken to be disposed. Note that multiple chips are provided so as to cover the maximum width of the expected sheet size in the X direction that intersects the conveying direction (Y direction; see FIG. 18). A technique using heating elements, a technique using piezo elements, a technique using electrostatic elements, or a technique using MEMS elements, for example, may be implemented as the technique by which the individual printing elements eject ink. Ink of each color is supplied to the respective print heads via ink tubes from ink tanks, not illustrated, which are provided inside the apparatus.

The inspecting unit 5 optically scans an inspection pattern or image printed on the sheet by the printing unit 4, and detects such as the ejection state of the print head 14, the sheet conveying state, and the image position.

The cutter unit 6 uses a cutter to cut the continuous sheet to a predetermined length after printing. The cutter unit 6 is also provided with multiple conveying rollers for sending the cut sheet to the next step.

The information printing unit 7 is a unit that prints information such as a print serial number and data on the back of the cut sheet.

The drying unit 8 is a unit that heats the sheet printed by the printing unit 4 to quickly dry applied ink. The drying unit 8 is also provided with a conveying belt and conveying rollers for sending the sheet to the next step.

The sheet winding unit 9 is a unit that uses a winding drum to temporarily wind a continuous sheet that has finished printing on the front when conducting duplex printing. After temporarily winding the continuous sheet that has finished printing on the front but has not yet been individually cut, the winding drum rotates in the opposite direction to feed the continuous sheet into the decurler 2 and again into the printing unit 4. Since the continuous sheet is reversed front-to-back at this point, the printing unit 4 is able to print with the print head 14 on the back side which has not yet been printed.

The delivery conveying unit 10 conveys cut sheets that have been cut by the cutter unit 6 and dried by the drying unit 8 to the sorter 11.

The sorter 11 sorts printed sheets as necessary, and delivers sorted sheets separately into different delivery trays for each group.

The control unit 13 is a unit that controls the above printing apparatus 1 overall. The control unit 13 includes a power supply and a controller 15 provided with a CPU, memory, and various I/O interfaces. The operation of the printing apparatus 1 is controlled on the basis of commands from the controller 15 or external equipment 16 such as a host computer connected to the controller 15 via an I/O interface.

Figures 4, 4A:
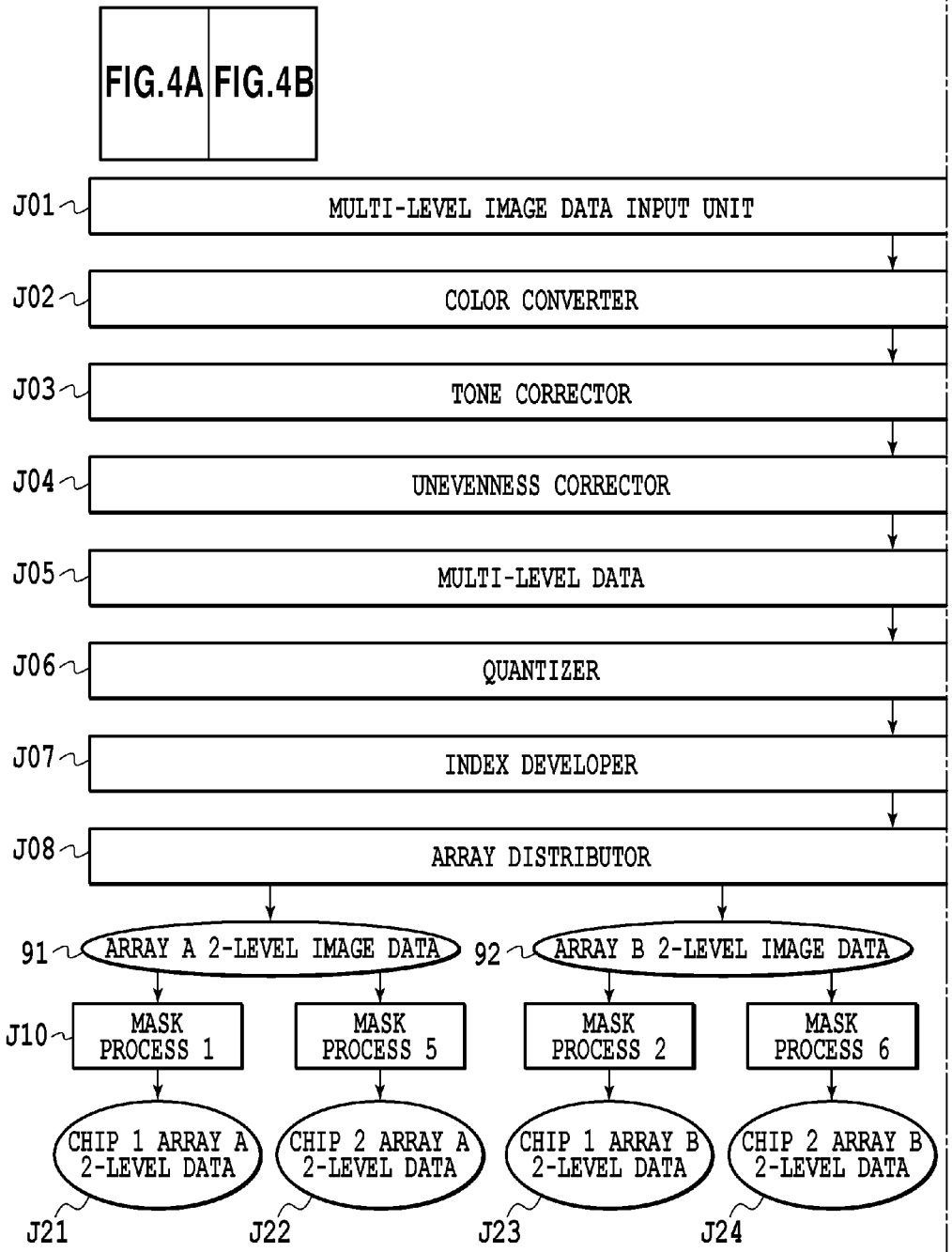
FIG. 4 is a diagram showing the relationship of FIGS. 4A and 4B.
FIG. 4A is a block diagram illustrating an image processing mechanism in a controller.
Figure 4B:
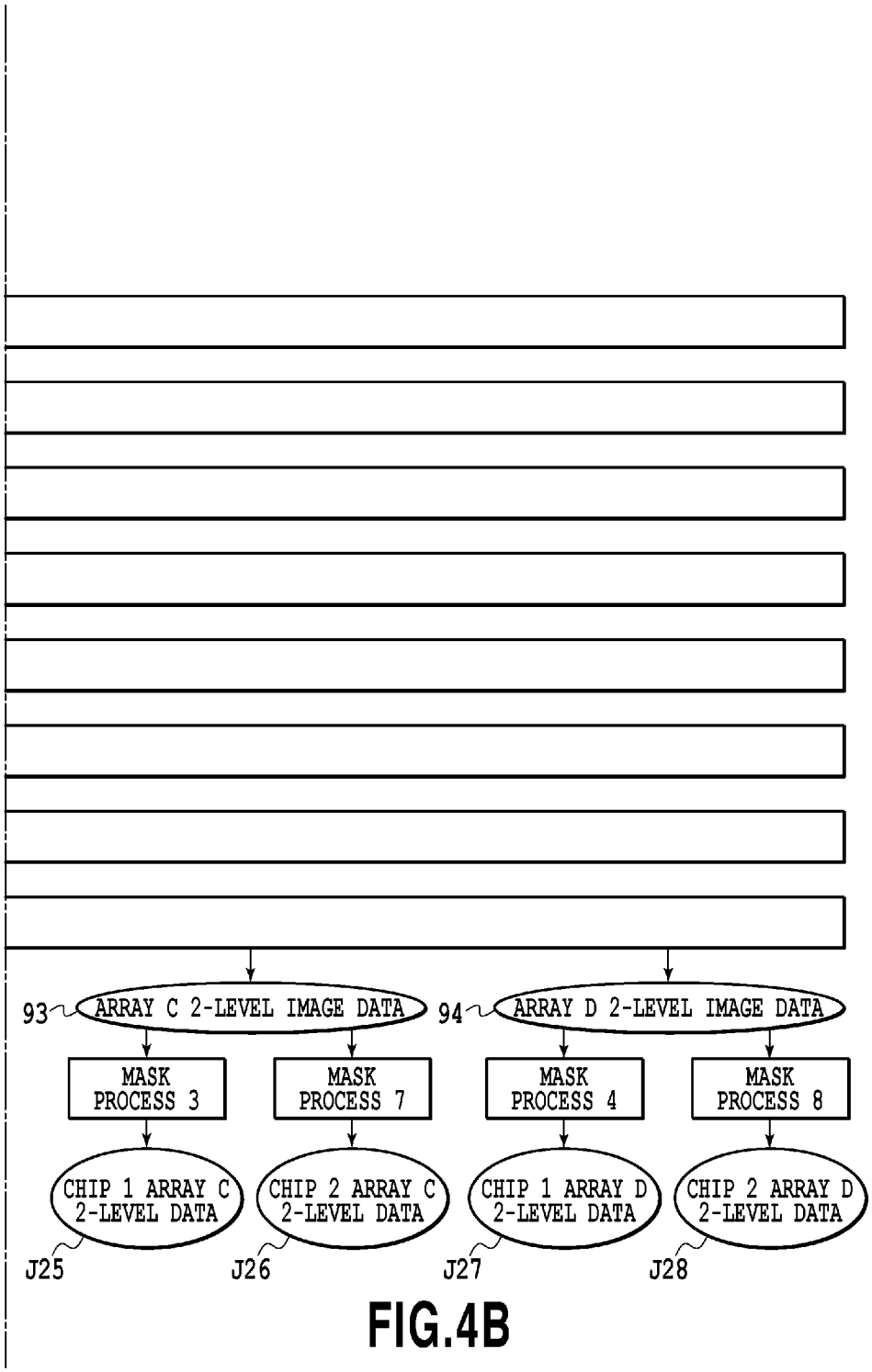
FIG. 4B is a block diagram illustrating an image processing mechanism in a controller.

FIGS. 4A and 4B are a block diagram illustrating an image processing mechanism for converting image data that the controller 15 receives from the external equipment 16 into print data that the print head 14 is able to print.

A multi-level image data input unit J01 receives multi-level image data to be printed by the printing apparatus 1 from the external equipment 16, and transmits the multi-level image data to a color converter J02. In this example, the received image data is taken to be 8-bit (256-tone) RGB data at a resolution of 600 dpi by 600 dpi. The color converter J02 uses a three-dimensional lookup table to convert the received multi-level image data (RGB) into similarly 8-bit (256-tone) multi-level density data corresponding to the ink colors used by the printing apparatus 1 (CMYKLcLm). Hereinafter, only the black data (K) will be described, for the sake of simplicity.

The subsequent tone corrector J03 uses a one-dimensional lookup table to correct the 256-tone density data into similarly 256-tone density data in order to obtain linearity between the input data and the density expressed on the print medium.

In addition, an unevenness corrector J04 uses a lookup table associated with each printing element to further correct the 256-tone density data in order to correct the density properties of the individual printing elements.

A quantizer J06 executes a quantizing process on the 256-tone density data output from the unevenness corrector J04. At this point, assume that multi-level error diffusion is used to downconvert the 256-tone multi-level data into 8 levels.

Figure 5:
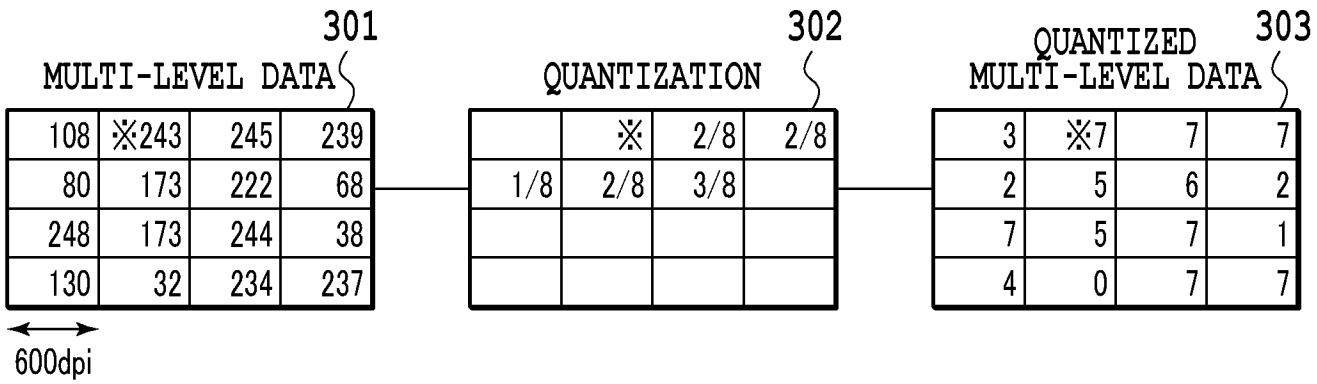
FIG. 5 is a diagram specifically illustrating an example of quantization executed by a quantizer.

FIG. 5 is a diagram specifically illustrating an example of quantization from 256 levels to 8 levels executed by the quantizer J06. In the case of quantization into 8 levels, multi-level data 301, in which individual pixels take a value from 0 to 255, is compared to seven levels of threshold values and converted into quantized data 203 taking values from 0 to 7. At this point, the error generated as a result of the quantization process on the starred target pixel, for example, is distributed to surrounding pixels in accordance with diffusion coefficients 302. The multiple diffusion errors generated in the surrounding pixels whose quantization is already finished are then added to the multi-level data possessed by the individual pixels, and the result is then compared to threshold values and quantized.

Density data converted into 8 levels by the quantization process is subsequently converted into 3-level data by an index developer.

Figure 6:
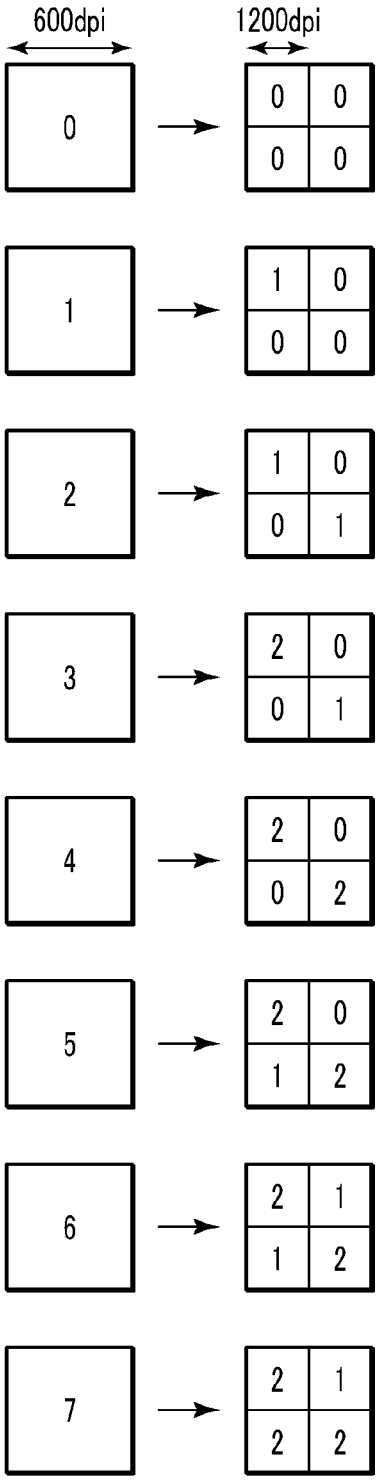
FIG. 6 is a diagram illustrating an index table referenced in an index development process.

FIG. 6 is a diagram illustrating an index table referenced in an index development process. One pixel in a 600 dpi by 600 dpi grid is equivalent to a 2×2 pixel area in a 1200 dpi by 1200 dpi grid, and 8-level data in a 600 dpi by 600 dpi grid is converted into 3-level data in a 1200 dpi by 1200 dpi grid. In FIG. 6, pixels labeled 0 in the 1200 dpi by 1200 dpi grid represent pixels where a dot is not printed, while pixels labeled 1 represent pixels where one dot is printed, and pixels labeled 2 represent pixels where two dots are printed. FIG. 6 demonstrates how the number of dots printed in the 2×2 pixel area of the 1200 dpi by 1200 dpi grid increases as the tone level rises in the 600 dpi by 600 dpi grid.

The density data (0 to 2) converted into 3-level data by the index process is transmitted to a array distributor J08 and distributed as 2-level data (0 or 1) among the four printing element arrays, or if the data corresponds to a joining portion, the eight printing element arrays, arranged on each chip.

Figure 18:
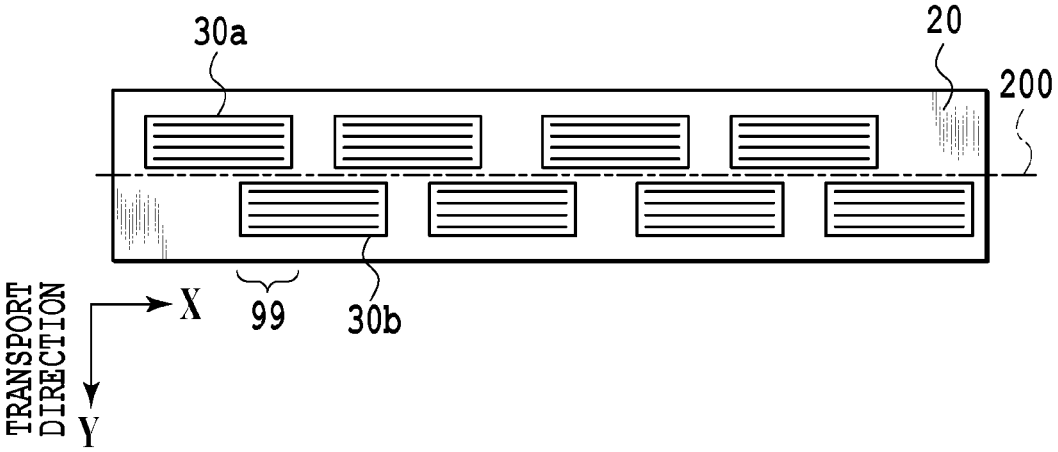
FIG. 18 is a diagram illustrating a joined head used in the embodiments.

FIG. 18 is a diagram illustrating an example of a joined head configured in this way. Multiple chips 30 are disposed continuously in the X direction on a base plate 20 while providing a joining portion 99 of predetermined size, with the chips 30 being alternately shifted in the Y direction so as to straddle a center line 200 extending in the X direction.

Figure 1:
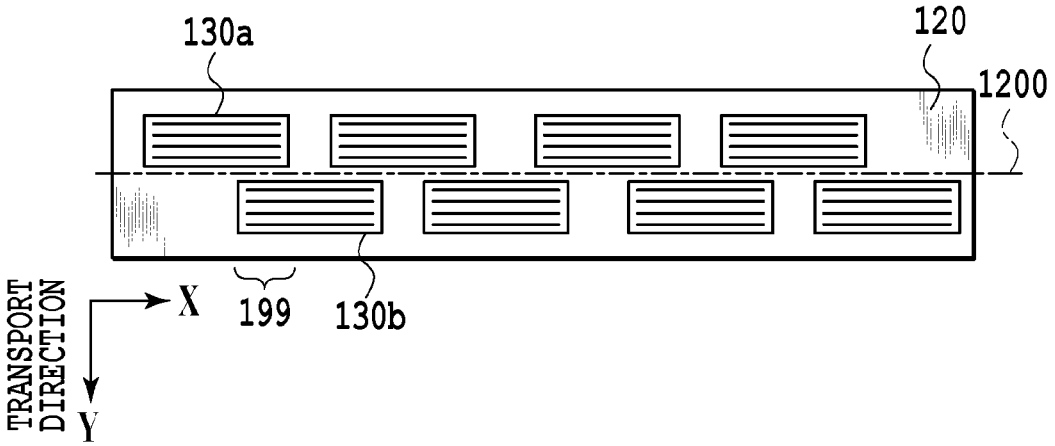
FIG. 1 is a diagram illustrating an example of a joined head.
Figure 2:
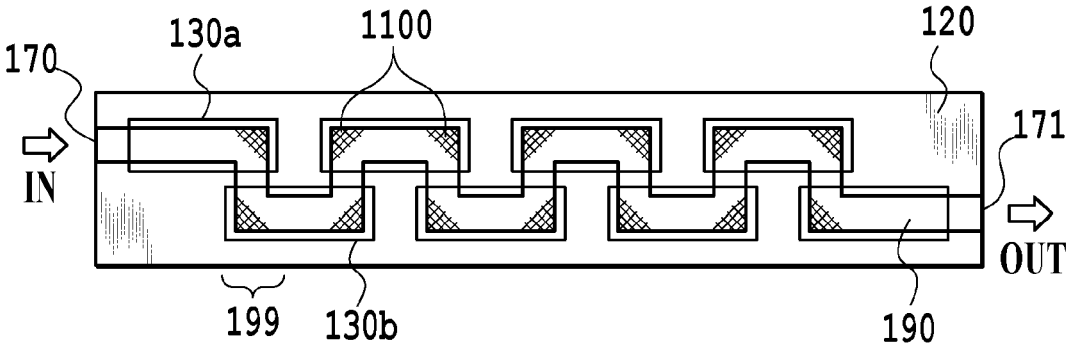
FIG. 2 is a diagram illustrating the path of an ink channel for sharing ink among multiple chips.
Figure 19:
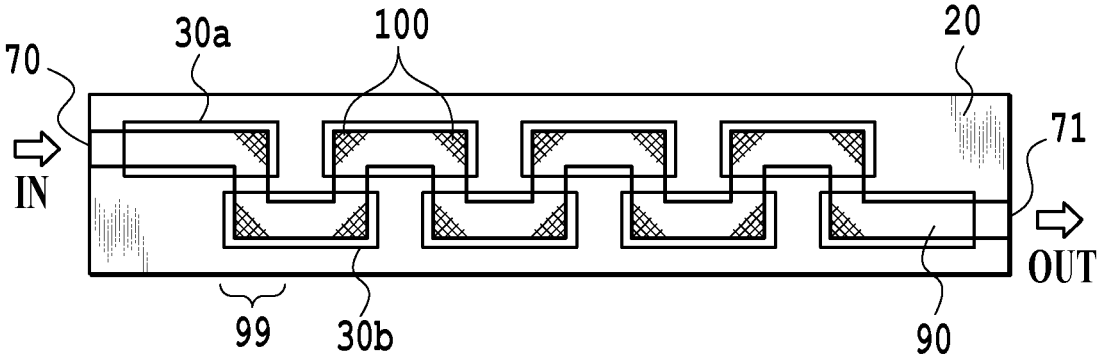
FIG. 19 is a diagram illustrating the path of an ink channel for sharing ink among multiple chips used in the embodiments.

FIG. 19 is a diagram illustrating the path of an ink channel for sharing ink among multiple chips 30. The ink channel 190 is provided in the base plate 20 while curving in a zigzag manner as illustrated in FIG. 2, and guides ink received from an ink supply port 70 to an ink discharge port 71 while supplying ink to each of the multiple chips 30 successively and in series. In the individual chips 30, supplied ink is ejected from individual printing elements in accordance with print data received from a printing apparatus.

Figure 7:
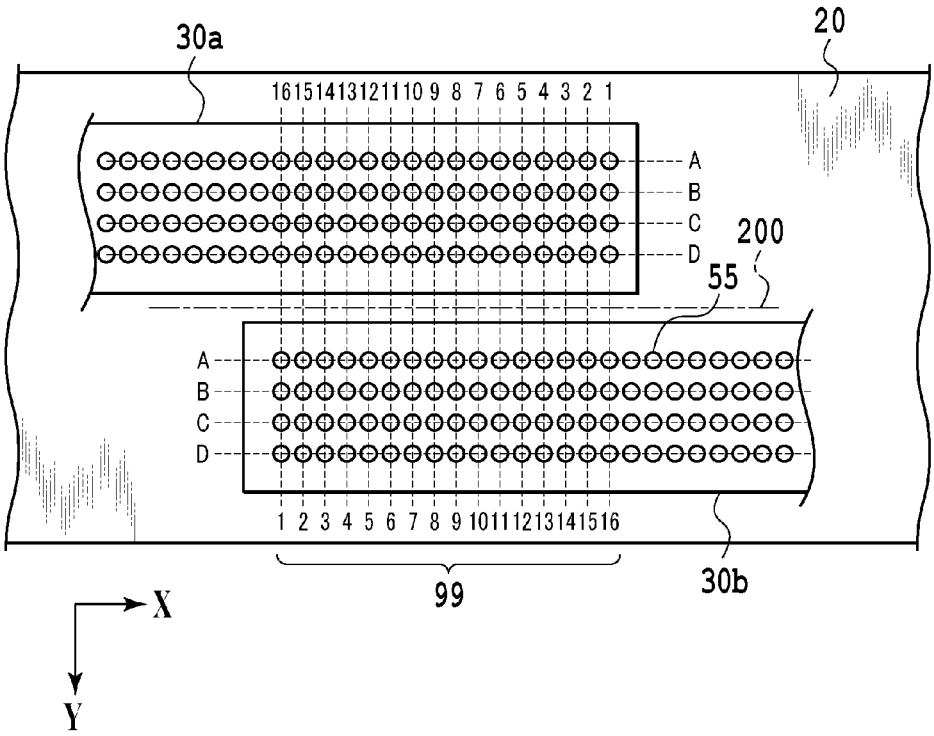
FIG. 7 is an enlarged view illustrating the state of a printing element layout near a joining portion of a print head.

FIG. 7 is an enlarged view illustrating the state of a printing element layout near a joining portion of the print head illustrated in FIG. 18. As illustrated in FIG. 18, a joined head is made up of a printing element substrate, in which multiple chips 30 are alternately disposed on either side of a center line 200 parallel to the printing element arrays on a base plate 20, and an ink channel that supplies ink to each of the multiple chips 30 successively and in series. FIG. 7 illustrates, minus the channel, the layout of printing elements on a first chip 30*a* and a second chip 30*b* which form an overlapping area (joining portion). Four printing element arrays A to D are disposed in parallel on the individual chips in the Y direction (the sheet conveying direction). If at a non-joining portion, a continuous area equal to the width of a single pixel in the Y direction is complementarily printed by four printing elements included on the printing element arrays A to D on a single chip. If at a joining portion, the continuous area is complementarily printed by eight printing elements included on two arrays each of the printing element arrays A to D on the two chips.

Referring once again to FIGS. 4A and 4B, with such a configuration, if the 3-level data for a predetermined pixel is 1, for example, the array distributor J08 distributes the print (1) data to one of the printing element arrays A to D, and distributes non-print (0) data to the remaining three arrays. If the 3-level data is 2, the array distributor J08 distributes print (1) data to two of the arrays A to D, and distributes non-print (0) data to the remaining two arrays. Additionally, if the 3-level data is 0, the array distributor J08 distributes non-print (0) data to all arrays. According to such processing by the array distributor J08, array A 2-level image data J91, array B 2-level image data J92, array C 2-level image data J93, and array D 2-level image data J94 is generated from the 3-level density data output from the index developer J07.

After that, in the case where the 2-level data corresponds to a non-joining portion, the 2-level data is transmitted as-is to the corresponding chips, and ink is ejected from the individual chips. On the other hand, in the case where the 2-level data corresponds to a joining portion, mask processes 1 to 8 are performed on the respective 2-level data to generate 2-level data J21 to J28 to be printed by respective printing element arrays on each chip.

Figure 8:
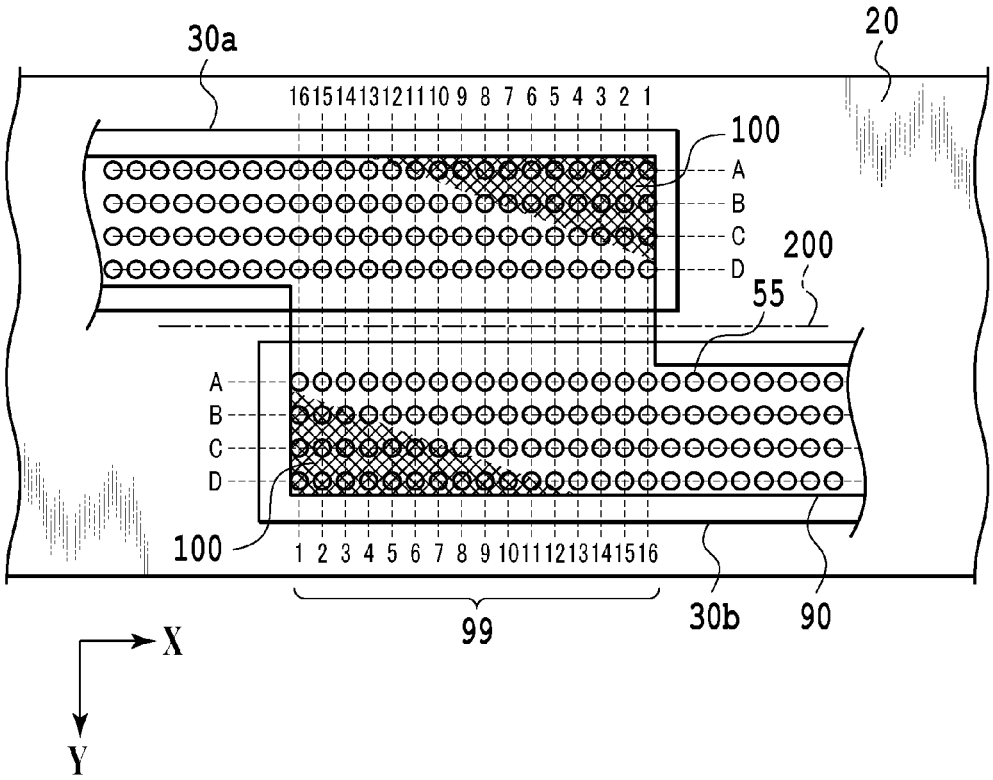
FIG. 8 is a diagram illustrating a channel overlaid with low flow rate areas.

FIG. 8 is a diagram illustrating the channel 90 overlaid with the low flow rate areas 100 in the joined head illustrated in FIG. 7. In this example, the chip 30*a* and the chip 30*b* contain 16 printing elements each in the arranging direction at the joining portion 99. In FIG. 8, these printing elements are labeled 1 to 16 for convenience.

The channel 90 that successively supplies ink to the chip 30*a* and then the chip 30*b* has turns at two locations in the joining portion 99, and the areas near these turns become low flow rate areas 100. In addition, the number of printing elements included in such low flow rate areas 100 differs among the individual printing element arrays A to D. For example, on the chip 30*a*, the printing elements 1 to 12 on the printing element array A, the printing elements 1 to 8 on the printing element array B, and the printing elements 1 to 4 on the printing element array C are included in a low flow rate area 100. Meanwhile, on the chip 30*b*, the printing elements 1 to 4 on the printing element array B, the printing elements 1 to 8 on the printing element array C, and the printing elements 1 to 4 on the printing element array D are included in a low flow rate area 100.

The number of printing elements included in such low flow rate areas 100 obviously changes according to various parameters, and the numbers indicated herein are merely one example. However, low flow rate areas typically extend out while centered on turns of the channel 90 as illustrated in FIG. 8, and the number of printing elements included therein is often determined to some extent by the structure of the print head. Thus, in the embodiments hereinafter, there are prepared characteristic mask patterns that as far as possible cause ejection operations to not be executed from printing elements included in low flow rate areas 100 corresponding to the turns of the channel 90 like those illustrated in FIG. 8.

Embodiment 1

Figure 9:
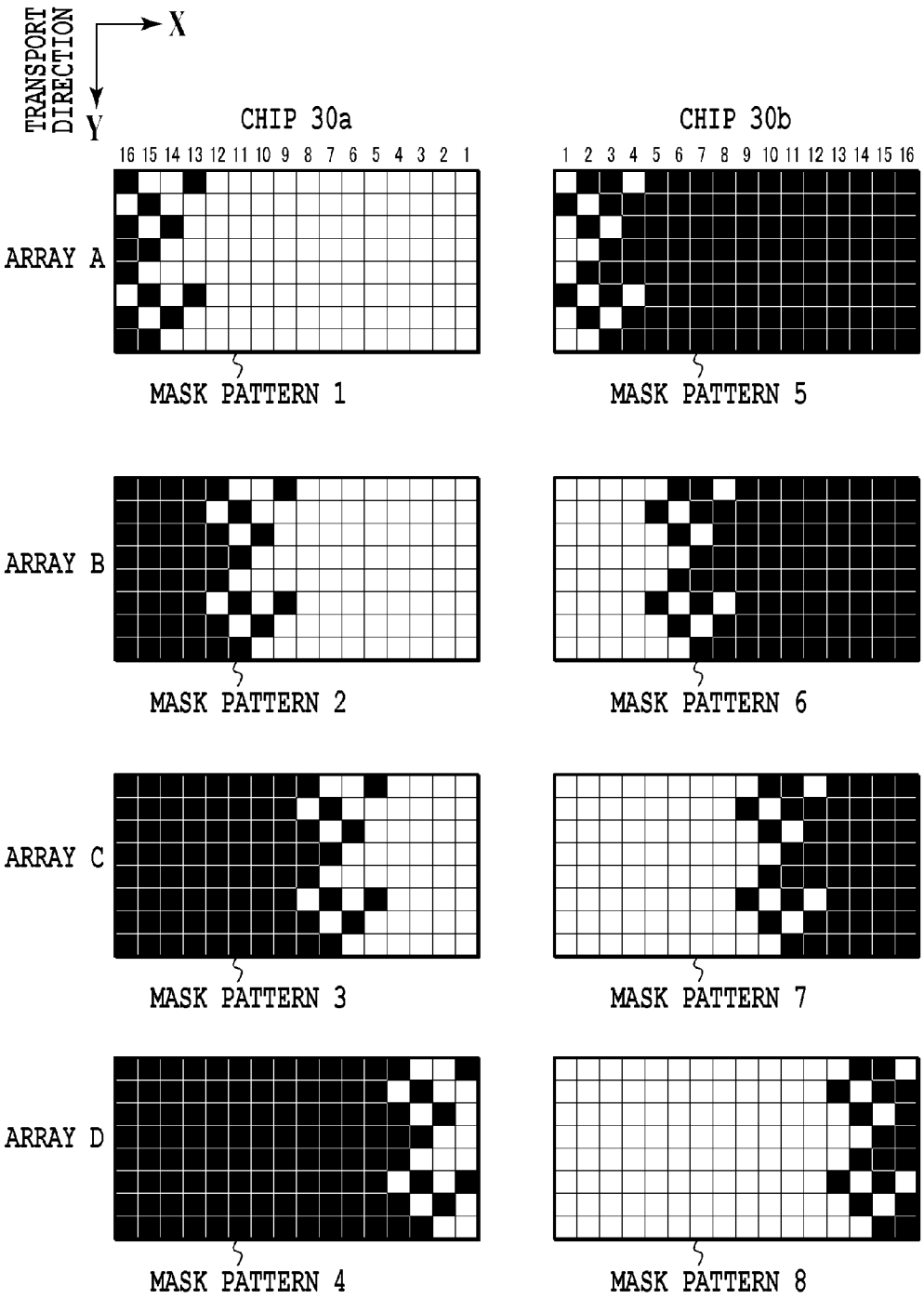
FIG. 9 is a diagram illustrating mask patterns used in Embodiment 1.

FIG. 9 is a diagram illustrating mask patterns used in respective mask processes 1 to 8 in Embodiment 1. FIG. 9 illustrates an 8-pixel area in the Y direction for the respective printing elements 1 to 16 included in the joining portion 99, with black representing allowed pixels that allow the printing of a dot, and white representing disallowed pixels that do not allow the printing of a dot.

For example, the array A 2-level image data J91 illustrated in FIG. 4A is subjected to a logical product operation with the mask pattern 1 in FIG. 9 by the mask process 1, and the result becomes the array A print data J21 for the chip 30*a*. Also, the same array A 2-level image data J91 is subjected to an AND operation with the mask pattern 5 by the mask process 2, and the result becomes the array A print data J22 for the chip 30*b*. The mask pattern 1 and the mask pattern 5 have a mutually complementary relationship, structured such that the array A 2-level image data J91 is printed by either the array A on the chip 30*a* or the array A on the chip 30*b*. The above relationship similarly holds for the array B 2-level image data J92, the array C 2-level image data J93, and the array D 2-level image data J94.

At this point, comparing the mask pattern 1 for the array A, the mask pattern 2 for the array B, the mask pattern 3 for the array C, and the mask pattern 4 for the array D on the chip 30*a* demonstrates that the area of printing-allowed pixels extends to the right (towards the end of the chip) in the order of array A, array B, array C, array D. Conversely, on the chip 30*b* that uses complementary mask patterns to those of the chip 30*a*, the area of printing-allowed pixels extends to the left (towards the end of the chip) in the order of array D, array C, array B, array A.

Figure 10B:
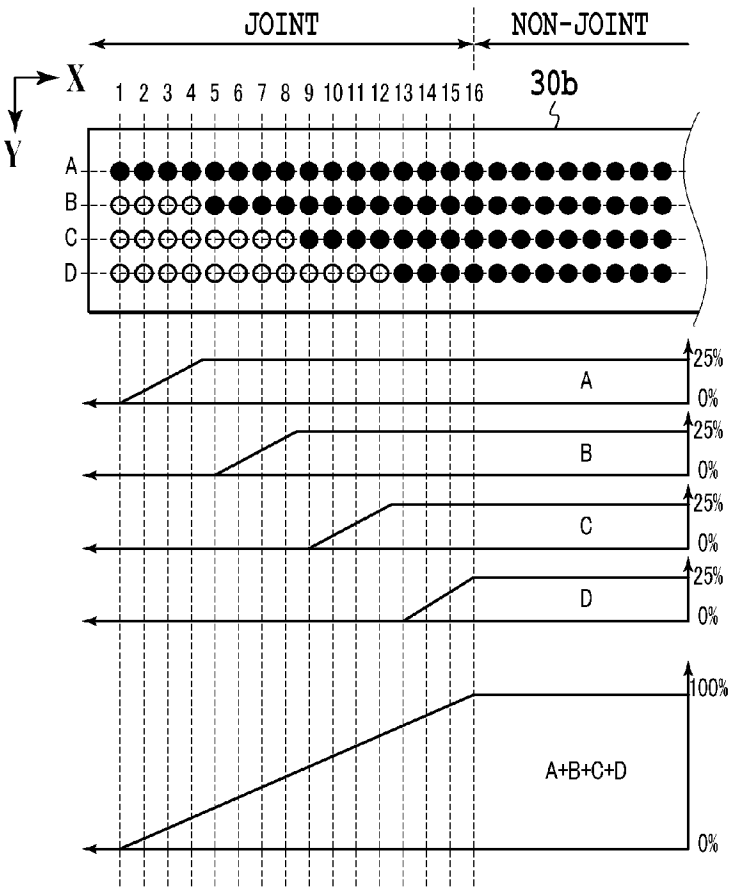
FIGS. 10A and 10B are diagrams illustrating allowed printing ratios for individual printing elements in Embodiment 1.
Figure 10A:
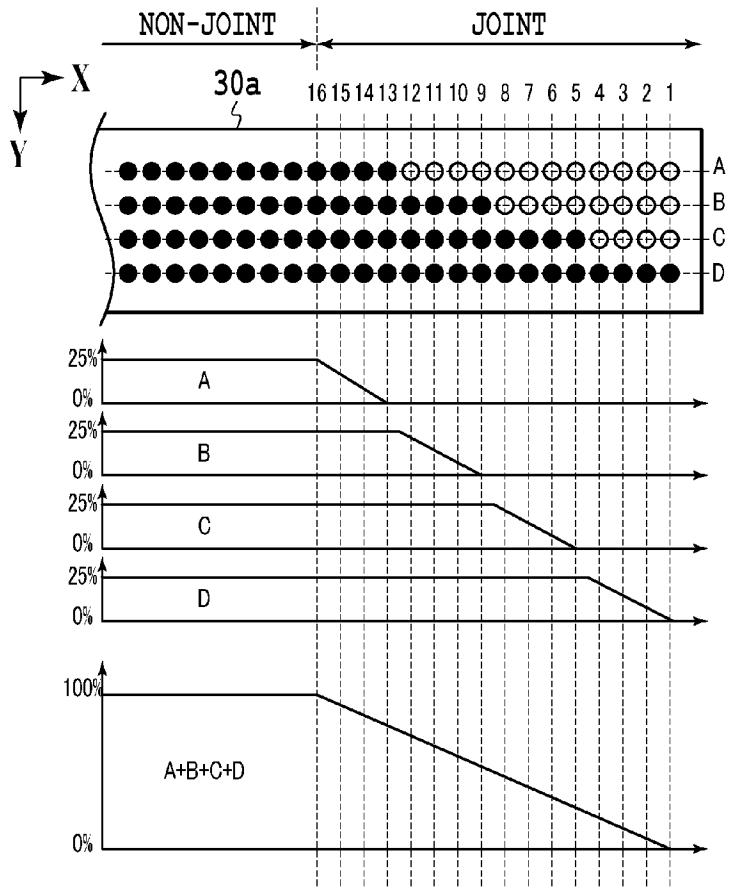

FIGS. 10A and 10B are diagrams illustrating allowed printing ratios for individual printing elements on the printing element arrays A to D when using the mask patterns illustrated in FIG. 9. FIG. 10A illustrates the case for the chip 30*a*, while FIG. 10B illustrates the case for the chip 30*b*.

In FIGS. 4A and 4B, the array distributor J08 equally distributes 2-level data to the four printing element arrays A to D. Thus, as illustrated in FIGS. 10A and 10B, the allowed printing ratio is a uniform 25% for all printing element arrays A to D at the non-joining portion where print data is not distributed across two chips by the mask process.

Meanwhile, the allowed printing ratios for each chip at the joining portion depend on the allowed printing ratios determined by the mask patterns. For example, referring to FIG. 9, since a number of the printing-allowed pixels of the printing element 16 on the chip 30*a* is 6 out of 8 pixels, the allowed printing ratio for the printing element 16 becomes 25%×6/8≈19%. Also, since a number of the printing-allowed pixels of the printing element 15 is 4 out of 8 pixels and a number of the printing-allowed pixels of the printing element 14 and that of the printing element 13 are 2 out of 8 pixels, the allowed printing ratios for these printing elements gradually reduces to approximately 13% and 6%, and becomes 0% for the printing elements 1 to 12. FIG. 10A demonstrates how the allowed printing ratio decreases with lower printing element numbers. In addition, in Embodiment 1, the gradation areas where the allowed printing ratio is gradually lowered from 25% to 0% from the center to the edge of the chip is limited to four printing element areas, which move towards the edge (to the right) in the order of array A, array B, array C, array D. Providing gradation areas in which the allowed printing ratio gradually changes in the arranging direction of the printing elements in this way is effective at mitigating discontinuity between two chips, and mutually dispersing variations in the ejection properties of each chip, similarly to Japanese Patent Laid-Open No. H05-057965 (1993).

Meanwhile, the chip 30*b* which exists in a complementary relationship with the chip 30*a* also has similar characteristics regarding allowed printing ratios at the joining portion. In other words, referring to FIG. 10B, although the allowed printing ratio decreases with lower printing element numbers, the gradation areas where the allowed printing ratio gradually changes moves towards the center (to the right) in the order of array A, array B, array C, array D.

Meanwhile, if mask patterns like those in FIG. 9 are used, the printing elements 1 to 12 on array A, 1 to 8 on array B, and 1 to 4 on array C on the chip 30*a* will not be used for printing at all. Likewise, the printing elements 1 to 12 on array D, 1 to 8 on array C, and 1 to 4 on array B on the chip 30*b* will not be used for printing at all. In FIGS. 10A and 10B, printing elements not used for printing in this way are indicated by white circles.

Figure 11:
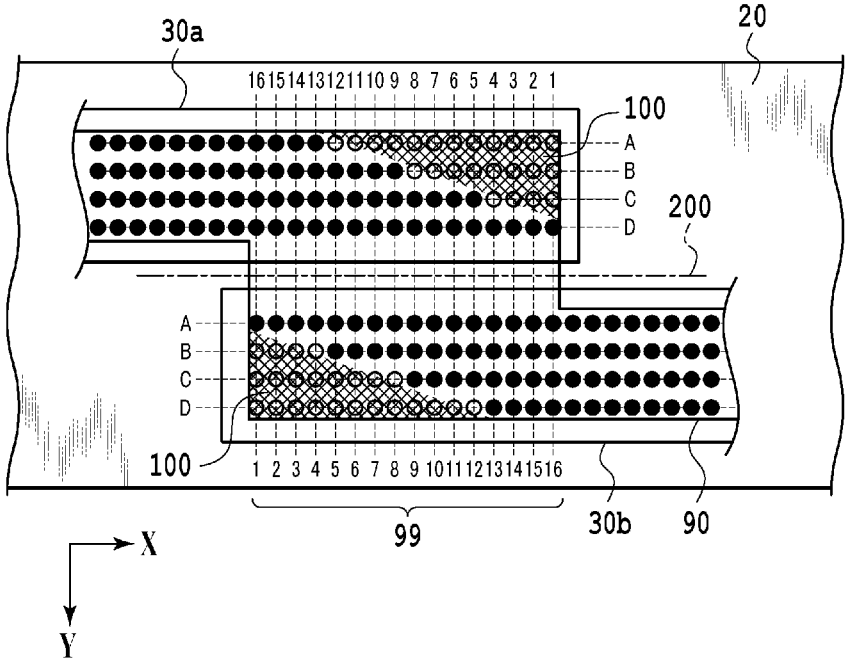
FIG. 11 is a diagram illustrating the relative positions of printing elements not used for printing and low flow rate areas.

FIG. 11 is a diagram illustrating the relative positions of printing elements not used for printing and low flow rate areas 100. FIG. 11 demonstrates how the printing elements included in the low flow rate areas 100 precisely match the printing elements not used for printing. In other words, in Embodiment 1, there are provided gradation areas in which the allowed printing ratio is gradually varied with respect to the arrangement of printing elements, while in addition, mask patterns are prepared such that only the printing elements included in the low flow rate areas 100 corresponding to the turns of the channel 90 are not used for printing on each printing element array. By using mask patterns that effectively exclude printing elements included in the low flow rate areas 100 in this way, it is possible to reduce the effects exerted on an image by the printing elements included in the low flow rate areas.

According to above construction, a number of printing element used for printing on printing element arrays B, C or D distanced from the turns of the channel 90 is smaller than a number of printing element used for printing on printing element arrays A closed to the turns of the channel 90.

Note that as already described, the positions and shapes of the low flow rate areas 100 change according to various parameters of the print head, and it is readily conceivable that these positions and shapes may dynamically change even in the same print head. However, since the low flow rate areas 100 basically extend out while centered on turns in the channel 90, there is a tendency, albeit with a degree of variation, for the number of printing elements included in the low flow rate areas 100 to increase for printing element arrays distanced farther from the center line 200 of the base plate. Thus, preparing mask patterns designed to reduce the number of printing elements used for printing on printing element arrays distanced farther from the center line 200 of the base plate as in Embodiment 1 is effective at suppressing the effects of the printing elements included in the low flow rate areas.

Figure 12:
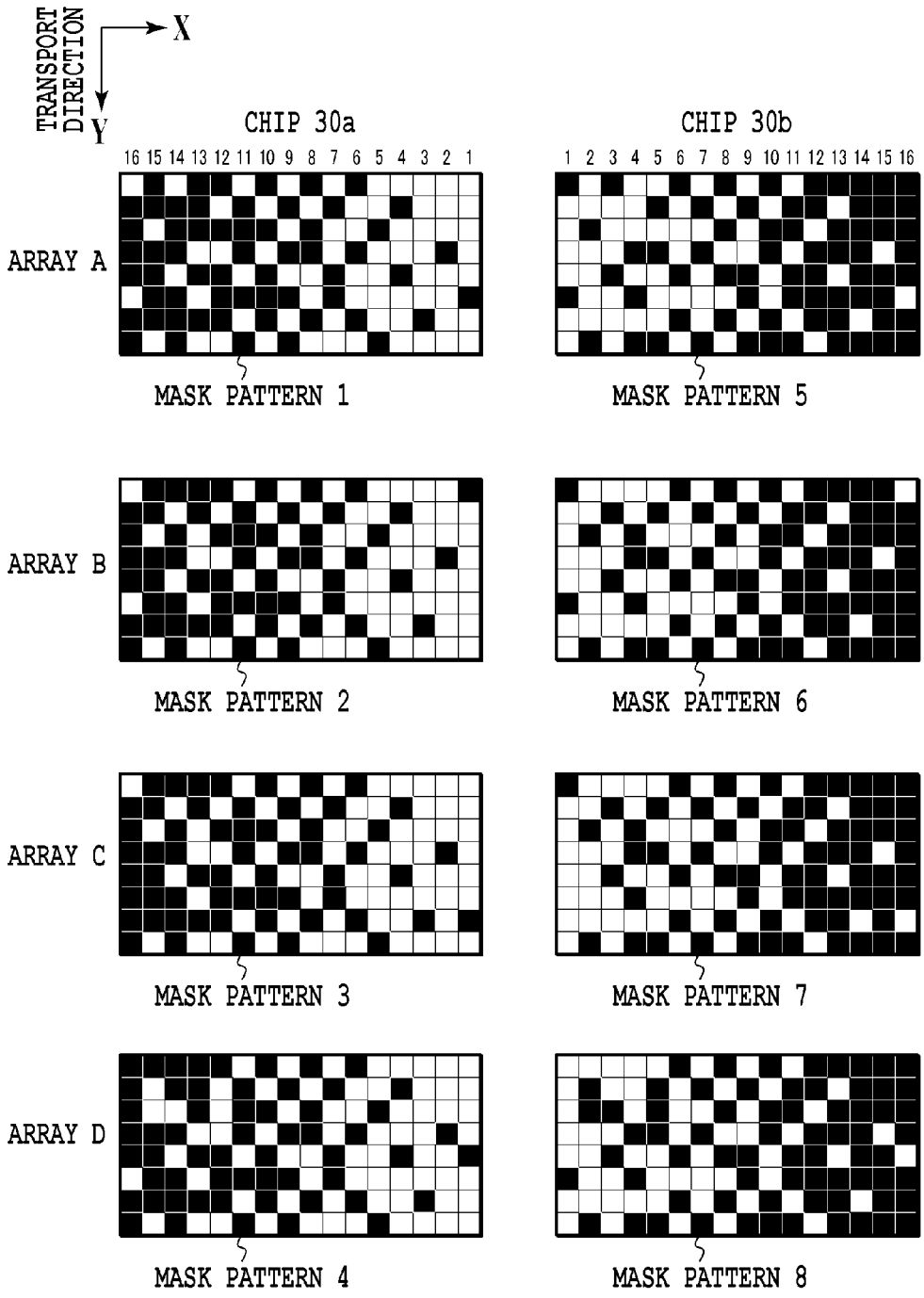
FIG. 12 is a diagram illustrating gradation masks of the related art.

FIG. 12 is a diagram illustrating gradation masks of the related art for the purpose of comparison with the present invention. In FIG. 12, the gradation masks of the related art exhibit no bias in the allowed printing ratio over all printing element arrays A to D, and although the allowed printing ratio does differ among the printing elements 1 to 16, all printing elements are used for printing.

Figure 13B:
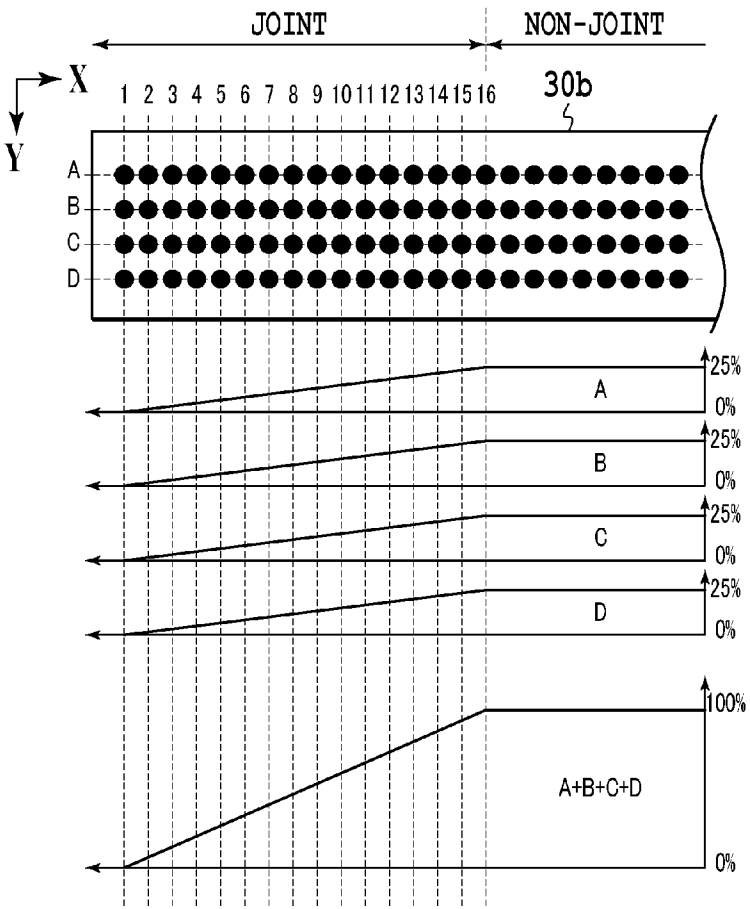
FIGS. 13A and 13B are diagrams illustrating allowed printing ratios for individual printing elements in a comparative example.
Figure 13A:
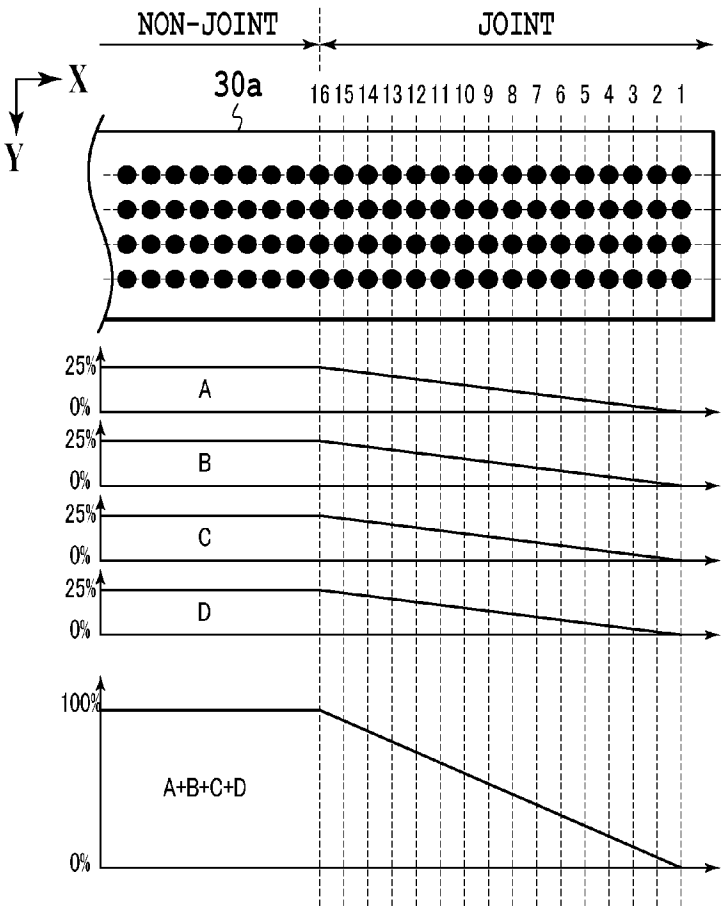

FIGS. 13A and 13B are diagrams illustrating allowed printing ratios for individual printing elements on the printing element arrays A to D when using the mask patterns illustrated in FIG. 12. In Embodiment 1 as illustrated in FIGS. 10A and 10B, 4-pixel gradation areas are provided, while in addition, printing elements not used for printing are prepared on the printing element arrays A to C. In contrast, in the comparative example, 16-pixel gradation areas are provided on all printing element arrays, and a printing element not used for printing does not exist on any of the printing element arrays.

Figure 14:
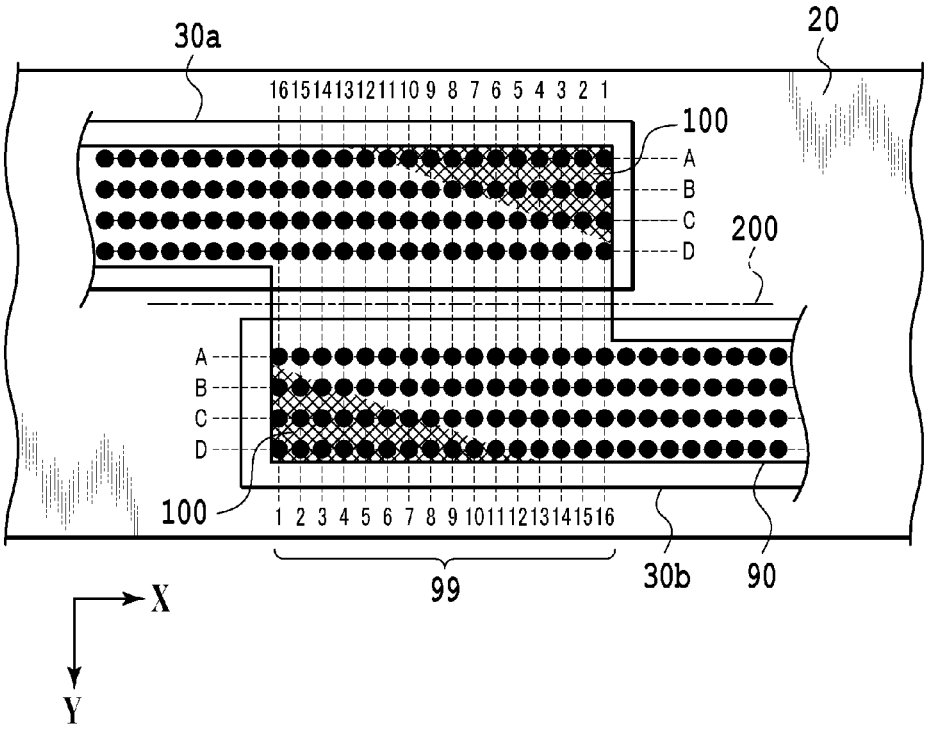
FIG. 14 is a diagram illustrating the relative positions of printing elements and low flow rate areas in a comparative example.

FIG. 14 is a diagram illustrating the relative positions of printing elements and low flow rate areas 100 in the comparative example. Obviously, in the comparative example even the printing elements included in the low flow rate areas 100 are used for printing. In other words, in the case of using gradation masks of the related art like those of the comparative example, ink is also ejected from printing elements included in the low flow rate areas 100, and thus image defects such as density unevenness which occur as a result cannot be suppressed as with Embodiment 1.

According to Embodiment 1 as described above, using gradation mask patterns designed to reduce the number of printing elements used for printing on printing element arrays distanced farther from the center line 200 of the base plate enables the output of an image which is less affected by the printing elements included in the low flow rate areas.

Embodiment 2

Figure 15:
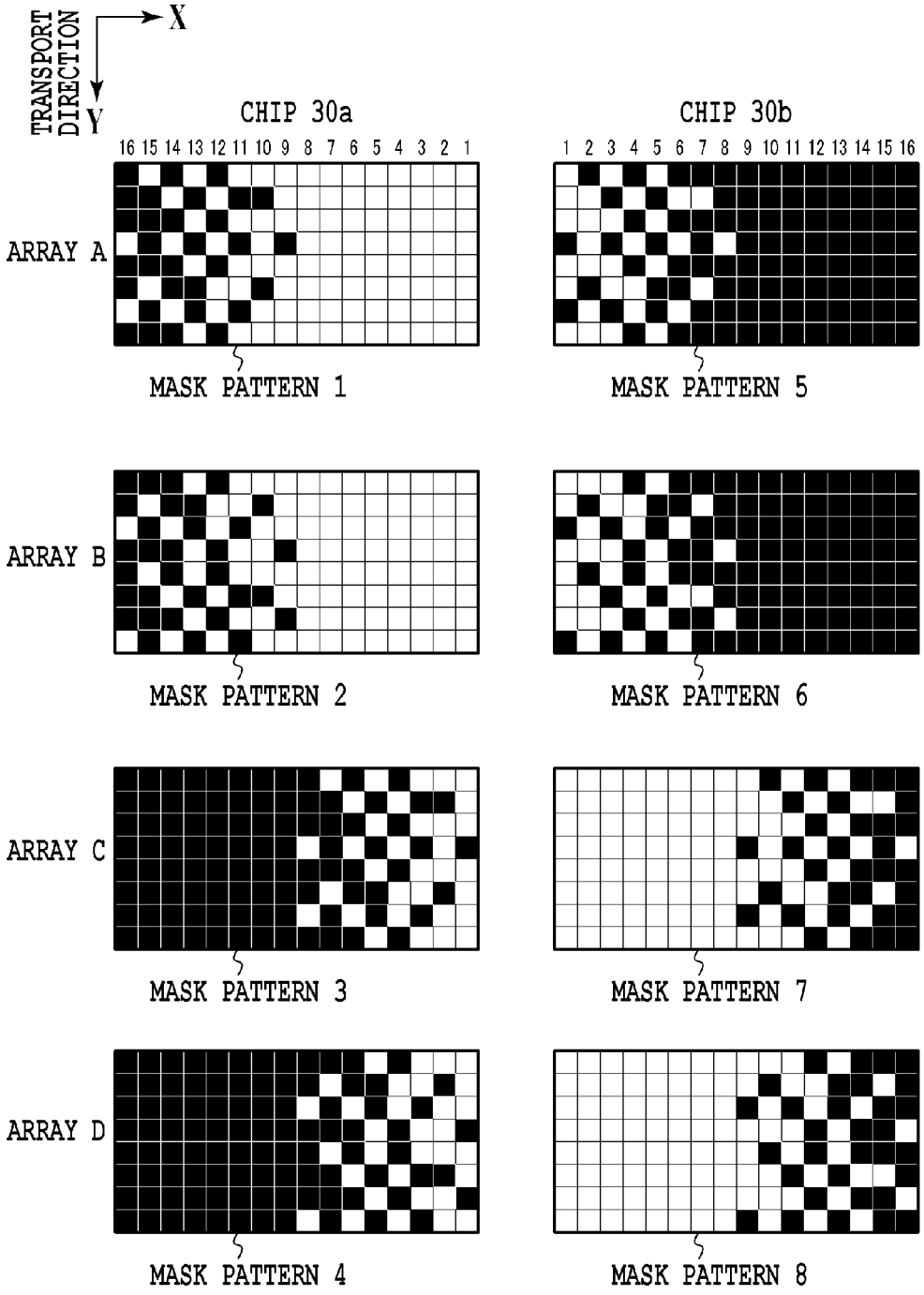
FIG. 15 is a diagram illustrating mask patterns used in Embodiment 2.

FIG. 15 is a diagram illustrating mask patterns used in Embodiment 2. The mask pattern 1 for array A, the mask pattern 2 for array B, the mask pattern 3 for array C, and the mask pattern 4 for array D on the chip 30*a* will now be compared. In this case, for array A and array B, the areas for the printing elements numbered 9 to 16 are gradation areas, while the printing elements numbered 1 to 8 are not used for printing. Meanwhile, for array C and array D, all printing elements are used for printing, but the areas for the printing elements numbered 1 to 8 are gradation areas. In this way, in Embodiment 2, the allowed printing ratios and the number of printing elements not used for printing is fixed at the same number for two adjacent printing element arrays among the four printing element arrays arranged on a chip.

Figure 16B:
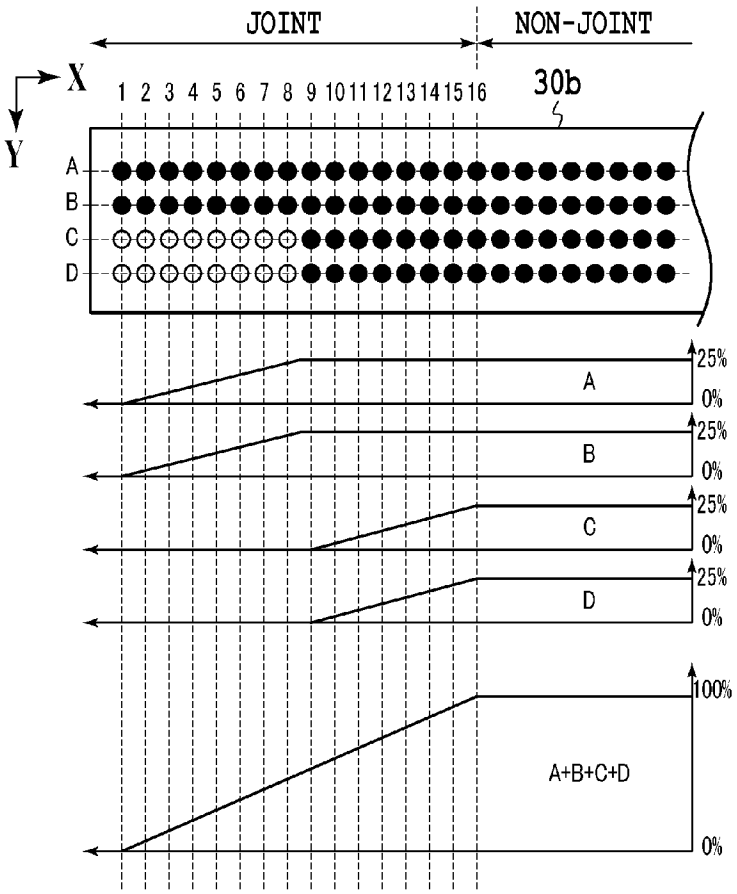
FIGS. 16A and 16B are diagrams illustrating allowed printing ratios for individual printing elements in Embodiment 2.
Figure 16A:
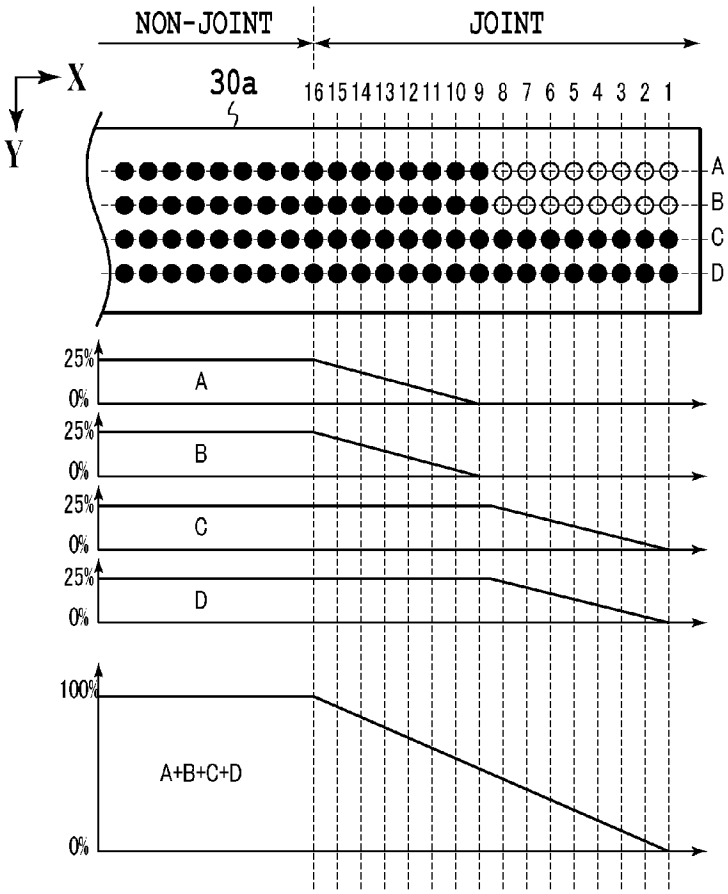

FIGS. 16A and 16B are diagrams illustrating allowed printing ratios for individual printing elements on the printing element arrays A to D when using the mask patterns illustrated in FIG. 15. FIGS. 16A and 16B demonstrate that in this embodiment, there are eight printing elements each which are not used for printing on the printing element arrays A and B on the chip 30*a*, and on the printing element arrays C and D on the chip 30*b*.

Figure 17:
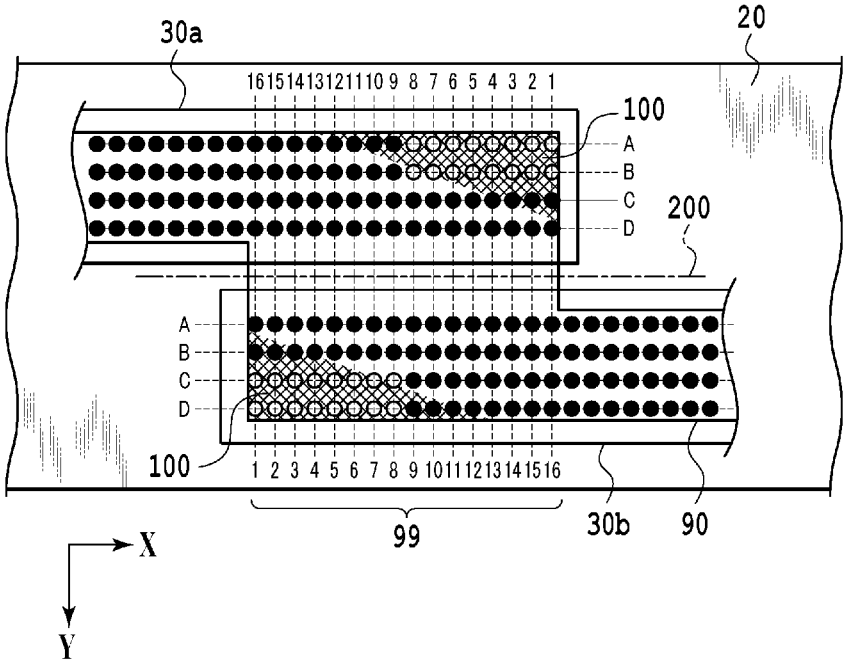
FIG. 17 is a diagram illustrating the relative positions of printing elements and low flow rate areas in Embodiment 2.

FIG. 17 is a diagram illustrating the relative positions of printing elements not used for printing as discussed above, and low flow rate areas 100. In FIG. 17, the positions of the low flow rate areas 100 are the same as in Embodiment 1. According to Embodiment 2, the positions of the low flow rate areas 100 and the positions of the printing elements not used for printing do not completely match compared to FIG. 11 illustrated in Embodiment 1. However, in Embodiment 2, there are still prepared gradation masks that reduce the number of printing elements used for printing on printing element arrays distanced farther from the center line of the base plate compared to printing element arrays nearer the center line. As a result, almost all of the printing elements included in the low flow rate areas 100 are not used for printing compared to the comparative example. Additionally, when considering that the ranges of the low flow rate areas 100 dynamically change, mask patterns such as those of Embodiment 2 can still be expected to sufficiently suppress image defects caused by ejection from printing element arrays included in the low flow rate areas 100.

Other Embodiments

The foregoing describes, as an example, the case of conducting the image processing illustrated in FIGS. 4A and 4B with the full-line inkjet printing apparatus 1 illustrated in FIG. 18. However, the present invention is not limited to the foregoing configuration. The present invention is able to exhibit its effects insofar as the inkjet printing apparatus 1 uses a print head configured such that multiple chips including multiple printing element arrays are disposed while providing joining portions. For example, the print head is not limited to the seven colors discussed above, and may also have the four colors CMYK, or the single color of black. The printing apparatus 1 obviously may also print onto cut paper rather than roll paper. Furthermore, the present invention still functions effectively when the printing apparatus 1 is not a full-line apparatus, but instead has a serial print head that prints an image while alternately performing print scans with a print head and sheet conveying operations.

Moreover, the image processing such as that from the color converter to the index developer is not limited to the method illustrated in FIGS. 4A and 4B. Insofar as 2-level data to be printed by multiple printing element arrays on a chip is generated as a result, the signal conversion method may involve any process, such as a quantization processing method, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-130659, filed Jun. 8, 2012, which is hereby incorporated by reference herein in its entirety.

What is claimed is:

1. An inkjet printing apparatus that prints an image on a print medium, comprising:

an inkjet print head provided with a printing element substrate including a plurality of chips for the same color made up of a plurality of printing element arrays, which contain printing elements for ejecting ink arranged in a predetermined arranging direction on a base plate for supporting the plurality of chips, wherein the plurality of chips are disposed in the predetermined arranging direction and providing joining portions where positions, in the arranging direction, of an respective end portions of adjacent chips overlap each other;

said base plate providing an ink channel to supply ink to each of the plurality of chips on the base plate successively, the ink channel having a plurality of turns of which positions correspond to respective end portions of the plurality of chips; and a distributing unit configured to distribute print data to each of the plurality of printing elements at the joining portions such that, among the plurality of printing element arrays on the chips, fewer printing elements execute ejection operations on a first printing element array than on a second printing element array which is positioned far from a corner of the turn in a direction intersecting with the predetermined arranging direction with respect to the first printing element array.

2. The inkjet printing apparatus according to claim 1, wherein the distributing unit distributes print data to each of the plurality of printing elements by performing a logical product operation between the print data and mask patterns that determine whether printing is allowed or disallowed for individual printing elements.

3. The inkjet printing apparatus according to claim 2, wherein the mask patterns determine whether printing is allowed or disallowed such that an allowed printing ratio for printing elements gradually rises from the edge to the center of the chips.

4. The inkjet printing apparatus according to claim 1, wherein the chips are disposed on alternating sides of a center line of the base plate substantially parallel to in the arranging direction and the second printing element array is positioned closer to the center line than the first printing element array, and the distributing unit distributes print data to each of the plurality of printing elements at the joining portions such that, among the plurality of printing element arrays on the chips, the farther distanced a printing element array is from the center line, the fewer printing elements execute ejection operations.

5. The inkjet printing apparatus according to claim 1, wherein the distributing unit distributes print data to each of the plurality of printing elements at the joining portions such that, among the plurality of printing element arrays on the chips, the number of printing elements that do not execute ejection operations is the same for two adjacent printing element arrays.

6. An inkjet printing method that prints an image on a print medium using an inkjet printing apparatus, comprising an inkjet print head provided with a printing element substrate including a plurality of chips for the same color made up of a plurality of printing element arrays, which contain printing elements for ejecting ink arranged in a predetermined arranging direction on a base plate for supporting the plurality of chips, wherein the plurality of chips are disposed in the predetermined arranging direction and providing joining portions where positions, in the arranging direction, of an respective end portions of adjacent chips overlap each other;

said base plate providing an ink channel to supply ink to each of the plurality of chips on the base plate successively, the ink channel having a plurality of turns of which positions correspond to respective end portions of the plurality of chips, the inkjet printing method comprising:

distributing print data to each of the plurality of printing elements at the joining portions such that, among the plurality of printing element arrays on the chips, fewer printing elements execute ejection operations on a first printing element array than a second printing element array which is positioned far from a corner of the turn in a direction intersecting with the predetermined arranging direction with respect to the first printing element array.

7. An inkjet printing apparatus that prints an image on the print medium comprising:

an inkjet print head provided with a printing element substrate including a plurality of chips made up of a plurality of printing element arrays, which contain printing elements used to eject ink arranged in a predetermined arranging direction on a base plate for supporting the plurality of chips, wherein the plurality of chips are disposed in an direction intersecting with the arranging direction, the chips being disposed on alternating sides of a center line of the base plate substantially parallel to the arranging direction such that the printing elements are contiguous in the arranging direction, while also providing joining portions where adjacent chips which disposed on each side of the center line overlap each other in the arranging direction; and an ink channel provided in the base plate and having a plurality of turns so as to supply ink to each of the plurality of chips on the base plate successively and in series; and a determining unit configured to determine a rate of use of each of the plurality of printing elements at the joining portions such that, among the plurality of printing element arrays on the chips, fewer printing elements execute ejection operations on a first printing element array than a second printing element array which is positioned further from the turn of the ink channel than the first printing element array.

8. The inkjet printing apparatus according to claim 7, wherein the determining unit determines the rate of use of each of the plurality of printing elements by performing a logical product operation between the print data and mask patterns that determine whether printing is allowed or disallowed for individual printing elements.

9. The inkjet printing methods according to claim 6, wherein the distributing unit distributes print data to each of the plurality of printing elements by performing a logical product operation between the print data and mask patterns that determine whether printing is allowed or disallowed for individual printing elements.

10. The inkjet printing method according to claim 9, wherein the mask patterns determine whether printing is allowed or disallowed such that an allowed printing ratio for printing elements gradually rises from the edge to the center of the chips.

11. The inkjet printing apparatus according to claim 1, wherein the ink channel guides the ink from an inlet positioned at one side of the ink channel to an outlet positioned at the other side of the ink channel in the predetermined arranging direction.

12. The inkjet printing apparatus according to claim 11, wherein a flow rate in the corner of the turn of the ink channel is lower than a flow rate in other areas.

13. The inkjet printing apparatus according to claim 1, which performs printing operation by the printing element substrate while conveying the printing medium in a direction crossing the predetermined arranging direction.

14. The inkjet printing method according to claim 6, wherein the ink channel guides the ink from an inlet positioned at one side of the ink channel to an outlet positioned at the other side of the ink channel in the predetermined arranging direction.

15. The inkjet printing method according to claim 14, wherein a flow rate in the corner of the turn of the ink channel is lower than a flow rate in other areas.

16. The inkjet printing method according to claim 6, which performs printing operation by the printing element substrate while conveying the printing medium in a direction crossing the predetermined arranging direction.

* * * * *